US009863387B2

(12) United States Patent
Wiedmann et al.

(10) Patent No.: US 9,863,387 B2
(45) Date of Patent: Jan. 9, 2018

(54) HOLDER FOR FASTENING A FUEL DISTRIBUTOR TO AN INTERNAL COMBUSTION ENGINE, AND FUEL INJECTION SYSTEM HAVING SUCH A HOLDER

(71) Applicant: Robert Bosch GmbH, Stuttgart (DE)

(72) Inventors: Christian Wiedmann, Remseck (DE); Goekhan Guengoer, Eberdingen (DE); Thomas Froihofer, Brackenheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 330 days.

(21) Appl. No.: 14/408,816

(22) PCT Filed: Apr. 24, 2013

(86) PCT No.: PCT/EP2013/058485

§ 371 (c)(1),
(2) Date: Dec. 17, 2014

(87) PCT Pub. No.: WO2013/189637

PCT Pub. Date: Dec. 27, 2013

(65) Prior Publication Data

US 2015/0204295 A1 Jul. 23, 2015

(30) Foreign Application Priority Data

Jun. 20, 2012 (DE) ..... 10 2012 210 369

(51) Int. Cl.
*F02M 69/00* (2006.01)
*F02M 69/46* (2006.01)
*F02M 55/02* (2006.01)

(52) U.S. Cl.
CPC ..... *F02M 69/465* (2013.01); *F02M 55/025* (2013.01); *F02M 2200/09* (2013.01)

(58) Field of Classification Search
CPC ..... F02M 69/465; F02M 2200/09; F02M 55/025; F02M 61/14; F02B 77/13; F02F 7/006
See application file for complete search history.

(56) References Cited

U.S. PATENT DOCUMENTS 1,800,434 A * 4/1931 Christman ..... F16F 1/38 267/141.2
5,172,671 A * 12/1992 Peters ..... F02B 77/13 123/456

(Continued)

FOREIGN PATENT DOCUMENTS

DE 102005008038 A1 8/2006
EP 0 479 548 4/1992

(Continued)

OTHER PUBLICATIONS

International Search Report for PCT/EP2013/058485, dated Aug. 2, 2013.

*Primary Examiner* — Kevin A Lathers
(74) *Attorney, Agent, or Firm* — Norton Rose Fulbright US LLP; Gerard Messina

(57) ABSTRACT

A holder used for mounting at least one component on an add-on structure, e.g., an internal combustion engine, includes: a base element able to be connected to a component; a fixation element, which extends through the through bore of the base element and a damping element disposed in the through bore, in order to mount the base element on the add-on structure; a fixation sleeve; and a damping element surrounding an outer side of the fixation sleeve and form-fittingly connected to the fixation sleeve on at least one side along the longitudinal axis, and on at least one side the damping element is form-fittingly connected to the base element along the longitudinal axis.

13 Claims, 4 Drawing Sheets

(56) References Cited

U.S. PATENT DOCUMENTS

| | | | | |
|---|---|---|---|---|
| 5,513,603 | A * | 5/1996 | Ang | F02F 7/006 123/198 E |
| 6,591,801 | B1 * | 7/2003 | Fonville | F02F 7/006 123/195 C |
| 7,682,117 | B2 | 3/2010 | Holt et al. | |
| 2013/0104852 | A1 * | 5/2013 | Kannan | F02M 61/168 123/456 |

FOREIGN PATENT DOCUMENTS

| | | |
|---|---|---|
| EP | 1 353 081 | 10/2003 |
| EP | 2 363 593 | 9/2011 |

* cited by examiner

HOLDER FOR FASTENING A FUEL DISTRIBUTOR TO AN INTERNAL COMBUSTION ENGINE, AND FUEL INJECTION SYSTEM HAVING SUCH A HOLDER

BACKGROUND OF THE INVENTION

1. Field of the Invention

The present invention relates to a holder for fastening a component, especially of a fuel distributor, to an add-on structure, especially an internal combustion engine.

Furthermore, the present invention relates to the field of fuel injection systems for internal combustion engines of motor vehicles.

2. Description of the Related Art

U.S. Pat. No. 7,682,117 B2 describes a holder for fastening a fuel distributor rail for the direct injection to an internal combustion engine. The known holder has damping rings made of an elastomeric material. In addition, cylinder sleeves are provided, whose axial lengths are selected with reference to an axial length of a through hole through which a screw extends. When the screw is screwed in, the damping rings are acted upon and ensure additional damping in the region of the through hole.

The holder known from U.S. Pat. No. 7,682,117 B2 has the disadvantage that the elastic material of the damping rings is heavily stressed over the service life, so that material fatigue may occur. The arising forces act in particular on a small material cross-section of the damping rings. In addition, the damping rings are not loaded homogeneously, because the adjacent components have no support surfaces that would be oriented perpendicularly to an axial loading direction. Especially an edge of a component at which the damping ring is placed may be subjected to high peak loading.

BRIEF SUMMARY OF THE INVENTION

The holder according to the present invention, and the fuel injection system according to the present invention have the advantage of ensuring better vibration damping over the service life. More specifically, it is advantageous that sufficient noise damping is ensured even after an extended operating period.

The holder and the fuel injection system having the holder are particularly suitable for internal combustion engines for the direct injection of gasoline, in which case the fuel distributor may be designed as a fuel distributor rail. On the one hand, the fuel distributor may be used for distributing the fuel to a plurality of fuel injectors, especially high-pressure injectors, and on the other, the fuel distributor can be used as a common fuel store for the high-pressure fuel injectors. The fuel injectors are suitably connected to the fuel distributor, and they spray-discharge the fuel required for the combustion process into the respective combustion chamber of the internal combustion engine under high pressure. To do so, the fuel is compressed by a high-pressure pump and conveyed in controlled quantities into the fuel distributor via a high-pressure line.

The fuel distributor is mounted on the add-on structure with the aid of the holder. The add-on structure may be the internal combustion engine, in particular. More specifically, the add-on structure may be a cylinder head of an internal combustion engine. However, the holder according to the present invention and the fuel injection system according to the invention may be produced and sold independently of such an add-on structure, especially an internal combustion engine.

While in operation, the fuel distributor can be excited to vibrations in the audible frequency range. This may happen mainly because of noise sources in the fuel injectors that could be part of the fuel injection system. The structure-borne noise spreads from the injectors, e.g., via cups, the fuel distributor and one or more holder(s), to the add-on structure, from where disturbing noise which could possibly even penetrate into the interior of the vehicle may be emitted. However, such interfering noise is able to be damped by the damping element of the holder. Bothersome noise especially in the interior of the vehicle is able to be prevented in this manner. Especially the reduction of interfering noise that penetrates the interior of the vehicle is of great practical importance.

The add-on structure may advantageously be a cylinder head of the internal combustion engine. However, a connection via spacer sleeves or via further connecting elements is another option.

The performance and fatigue limit of the fuel distributor may pose a number of strict demands on the screw connection. For example, high static forces and dynamic alternating forces could act on the screw connection. There may be the additional stipulation not to exceed a particular relative movement of the fuel distributor in relation to the add-on structure, especially the cylinder head, in the operation between all operating points. Because of such function and fatigue requirements, in particular, it may be necessary for the fuel distributor to sit on the add-on structure in a relatively stiff manner. This heavily restricts damping and decoupling measures relating to vibrations and acoustics at the connection points, especially the screw-fit points, with regard to their elasticity. These requirements may advantageously be satisfied by the holder according to potential embodiments of the present invention. Vibrational decoupling and damping that is compatible with these requirements is able to be realized, in particular.

It is advantageous that at least one rigid inner layer of the damping element is form-fittingly connected to the fastening sleeve along the longitudinal axis on at least one side; that at least one rigid outer layer of the damping element is form-fittingly connected to the base element along the longitudinal axis on at least one side; and that at least one elastically deformable damping layer is disposed between the inner layer and the outer layer. Especially the damping element may be developed from exactly one inner layer, the damping layer, and precisely one outer layer. The inner layer, the damping layer and the outer layer may advantageously be integrally joined to each other. Relative movements in the axial direction will then arise between the inner layer and the outer layer during the operation. The damping layer extends along the longitudinal axis. This causes the damping layer to be acted upon in the shear direction, so to speak, in this relative movement. The acted upon cross-section of the material of the damping layer is therefore very large, which correspondingly reduces the stress arising in the damping layer and thereby avoids fatigue of the damping layer.

It is furthermore advantageous that the rigid inner layer is developed as a metallic inner layer and that the rigid outer layer is developed as a metallic outer layer. The damping element in particular may be developed as a damping metal panel having one or more viscoelastic damping layer(s). In this case the damping element may be bent in the form of a sleeve or partial sleeve, for example. Even a development of a sleeve-shaped damping element that is closed in the circumferential direction is conceivable. As a result, the installation direction of the damping element may advantageously be specified in such a way that the force transmission occurs mainly within the component rather than perpendicularly to the rigid layers. For the most part, the force transmission takes place parallel to the surface of the damping element.

Because of the use of the damping element, which is developed as a shear panel having at least one viscoelastic damping layer, it is possible to achieve damping of the vibrations of the fuel distributor at the fastening points of the fuel distributor. In addition, the transmission of structure-borne noise into the add-on structure is markedly reduced. Because of these two effects, the noise radiation and the noise conduction from the fuel distributor and the add-on structure are reduced. The vibration loading of the affected components is thereby able to be lowered as well.

The mechanical operating principle for reducing vibrations of the damping element having rigid layers and at least one interposed viscoelastic damping layer may be described as follows. One or more preferably thin viscoelastic damping layer(s) may be laminated between the preferably metallic rigid layers. The damping layer can be connected to the rigid layers by vulcanization, in particular. The damping layer may advantageously be made of a rubber-based material. The term rubber should be taken quite generally in this context, and besides natural rubber also includes synthetic rubber materials. In a relative movement of the two rigid layers, the interposed viscoelastic damping layer is dynamically subjected to significant shearing stress. This dissipates a high percentage of the vibrational energy through material damping.

The dissipation of structure-borne noise energy always leads to damping of vibration forms of the fuel distributor and consequently to a reduction in all structure-borne noise components that are transmitted from the fuel distributor into the add-on structure by way of the damping layer. This transmission path thus reduces the sound output and the effect corresponds to a decoupling or isolation of the fuel distributor.

The characteristics of the damping layer, such as the thickness or the material-specific properties, are adaptable with regard to some optimization parameters. Optimization parameters in particular may be the frequency contents to be damped, and the temperature. Multi-layer damping elements may be advantageous with regard to the individual application case. Especially a development featuring three metallic layers and two viscoelastic damping layers, which are layered on top of one another in alternation, is possible.

Because of the high material damping, a damping element having thin viscoelastic damping layers advantageously allows a considerable reduction in the vibration properties and the structure-borne noise transmission, without a rigid connection becoming too flexible in the process. In this way the rigid position of the fuel distributor on the add-on structure is basically maintainable, so that the respective functional requirements are satisfied.

Moreover, the holder may be designed for markedly lower transmittable forces because the damping layer of the damping element is used outside the force flow of the fastening element. As a result, the development of the holder advantageously differs from a conventional development, in which the damping rings in the form of washers and made of an elastic material are subjected to the tightening force of the screw element via the screw head. For the approach according to the present invention allows a development in which only the operating loads, but not additionally also the clamping force of the screws acts on the damping layer of the damping element. Furthermore, there are markedly lower settling effects because the damping element is loaded only during operation, while virtually no forces are transmitted otherwise because no static prestressing is active.

In an advantageous manner, multiple holders of this type are provided, which are used at all mounting points of the fuel distributor in order to maximize the effectiveness.

It is advantageous that the base body has a recess at an inner side and that the outside layer of the damping element is inserted in the recess of the base body in such a way that the outside layer of the damping element is form-fittingly connected to the base body along the longitudinal axis on both sides. As a result, a stationary fixation of the outer layer in relation to the base body is possible. The insertion of the damping element in the recess of the base element can be accomplished by compressing the damping element to a smaller outer diameter, provided the damping element is advantageously developed in the shape of a sleeve slotted along the longitudinal axis. Because of the prestressing of the damping element produced when it is compressed, it subsequently resumes its original form. This makes it possible to securely insert the damping element into the recess of the base element. In the assembled state, the damping element is also held in place by the fastening element, because it is impossible, for construction-related reasons, to reduce the outer diameter of the damping element once the fastening element is installed.

However, it is also advantageous that the base body has a recess featuring a step on an inner side, that the outer layer of the damping element is inserted into the recess of the base element, that, for one, the outer layer of the damping layer form-fittingly cooperates with the step at the recess of the base element along the longitudinal axis, and that for another, the outer layer of the damping element form-fittingly cooperates with a clamping sleeve, which is press-fit in the recess of the base element, along the longitudinal axis. Especially in this development, it is advantageous that the damping element is developed as a sleeve-shaped damping element. As a result, it is not necessary to reduce the outer diameter of the damping element for its insertion. For if the recess of the base body is open on one side, the damping element is insertable with or without play. A loss-prevention mechanism can then for realized with the aid of the clamping sleeve, which is able to be press-fit into the recess of the base element. In the assembled state, a reliable fixation of the damping element and furthermore, a bilateral keyed connection for the damping element are ensured over the service life.

It is advantageous that the securing sleeve has a recess including at least one step on its outer side, and that the inside layer of the damping element is inserted into the recess of the securing sleeve in such a way that the inner layer of the damping element form-fittingly cooperates with the step of the securing sleeve along the longitudinal axis. It is furthermore advantageous that, for one, the inner layer of the damping element form-fittingly cooperates with the step of the securing sleeve along the longitudinal axis, and for another, that it is at least indirectly braced on a head of the fastening element. This ensures a bilateral fixation of the inner layer of the damping element.

DETAILED DESCRIPTION OF THE INVENTION

Figure 1:
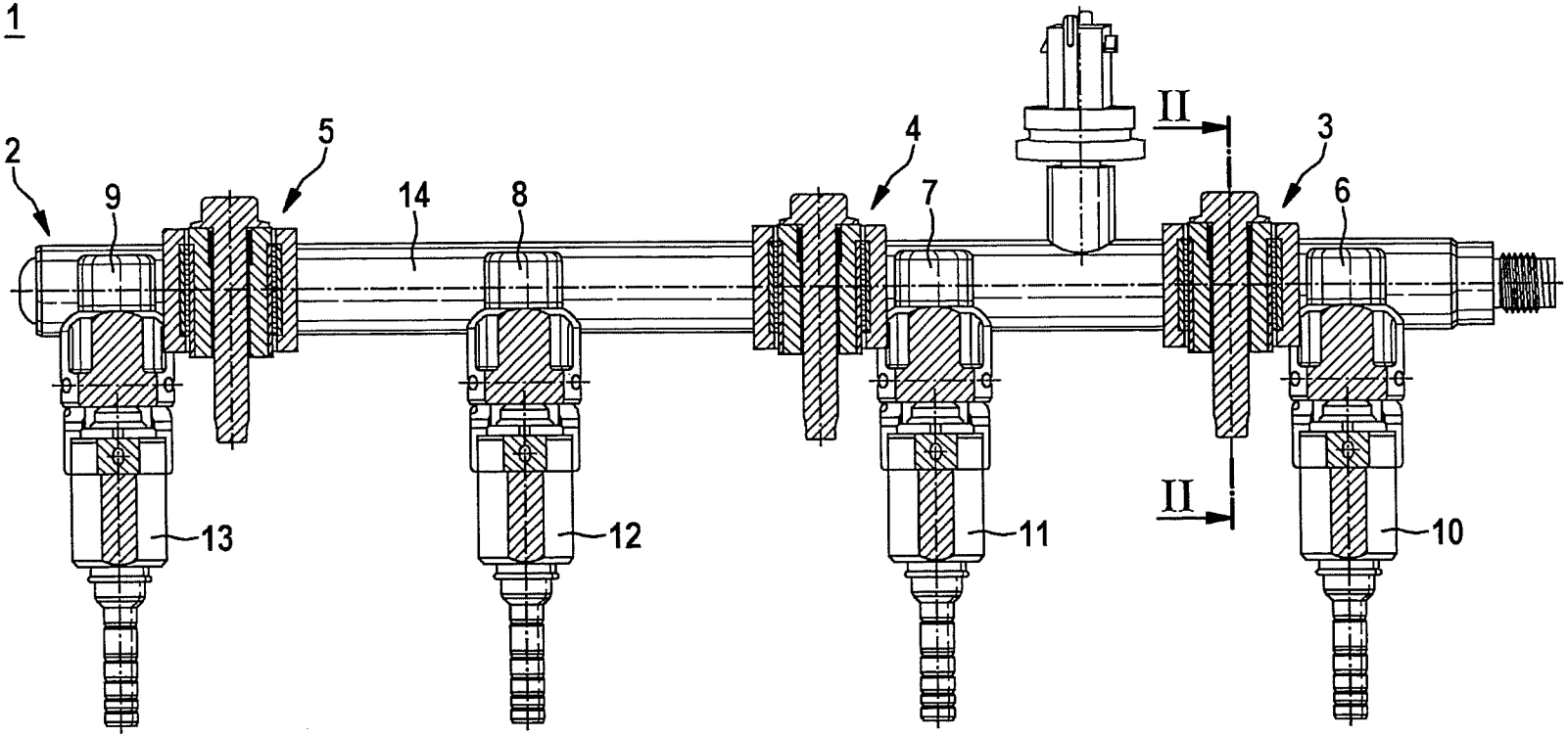
FIG. 1 shows a fuel injection system having a fuel distributor and multiple holders that are used to fasten the fuel distributor to an add-on structure, in an excerpted, schematic sectional representation corresponding to a first exemplary embodiment of the present invention.

FIG. 1 shows a fuel injection system 1 having a fuel distributor 2 and multiple holders 3, 4, 5 which are used to fasten fuel distributor 2 to an add-on structure 23 (FIG. 2), in an excerpted, schematic sectional representation corresponding to a first exemplary embodiment. Fuel injection system 1 in particular may be used for the high-pressure injection in mixture-compressing internal combustion engines having external ignition. Add-on structure 23, on which fuel distributor 2 is mounted via holders 3, 4, 5, may then be the internal combustion engine, especially a cylinder head of the internal combustion engine. Fuel distributor 2 has cups 6, 7, 8, 9. In addition, fuel injection system 1 has fuel injectors 10, 11, 12, 13, which are mounted on cups 6 through 9 of fuel distributor 2. In this exemplary embodiment, fuel distributor 2 is designed as a fuel distributor rail having a common injection rail 14.

In a corresponding variation, holders 3 through 5 may also be used to fasten other components to add-on structure 23.

Figure 2:
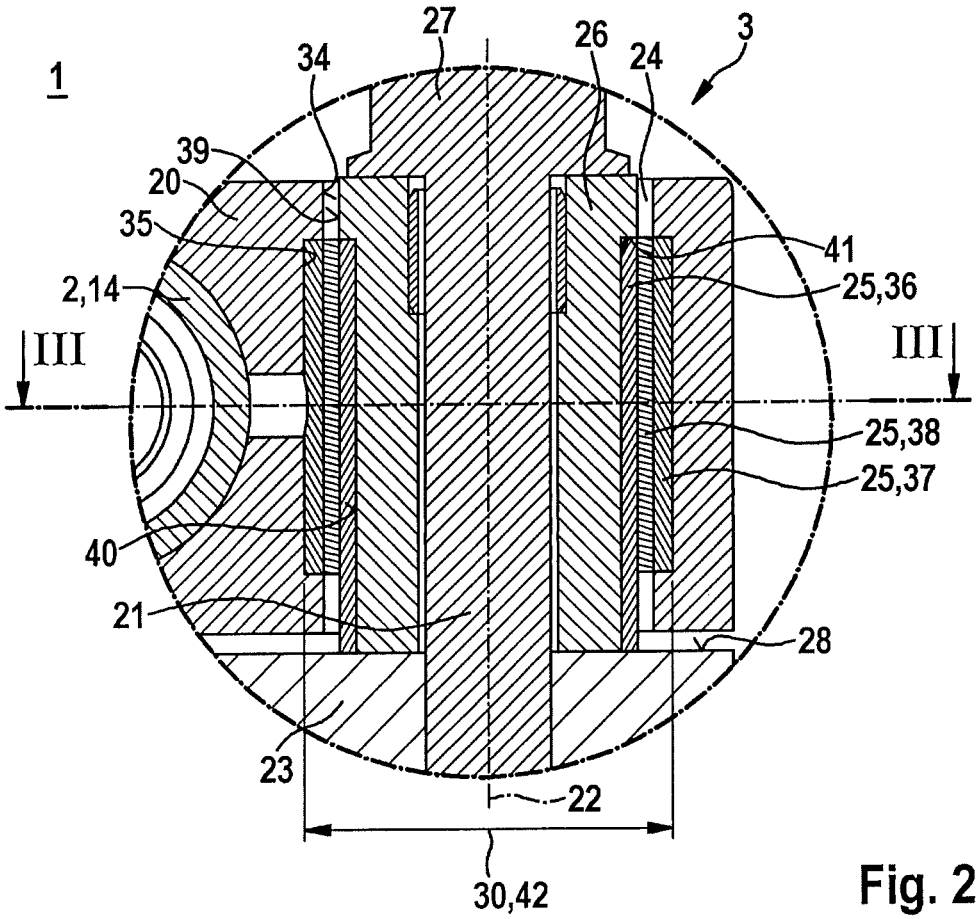
FIG. 2 shows an excerpted section through the fuel injection system shown in FIG. 1, corresponding to the first exemplary embodiment, along the cutting line denoted by II.

FIG. 2 shows an excerpted section along the cutting line denoted by II through fuel injection system 1 shown in FIG. 1, corresponding to the first exemplary embodiment. A section through holder 3 is shown in this instance. The development of holders 4, 5 of fuel injection system 1 corresponds to the development of holder 3. Holder 3 has a base element 20, which is connected to common injection rail 14 of fuel distributor 2. In addition, holder 3 includes a fastening element 21, which may be developed as a fastening screw, for instance. Fastening element 21 is able to be screwed into add-on structure 23, especially cylinder head 23, along an axis 22, or it may be connected thereto in some other manner.

Base element 20 has a through bore 24. Axis 22 simultaneously constitutes the axis (longitudinal axis) 22 of through bore 24. To secure base element 20 on add-on structure 23 along longitudinal axis 22 of through bore 24 of base element 20, fastening element 21 extends through the through bore 24 and through a damping element 25 situated in through bore 24. In addition, a securing sleeve 26 is provided, which is aligned along longitudinal axis 22 and through which fastening element 21 extends. Securing sleeve 26 is clamped and fixated between a head 27 and a top side 28 of add-on structure 23 by screwing fastening element 21 into add-on structure 23.

The mechanical connection between head 27 and base element 20 of holder 3 is created by way of securing sleeve 26 and damping element 25. In the assembled state, the fastening of base element 20 to add-on structure 23 thus takes place via damping element 25, among others. Vibrations or the like that occur during the operation act mainly along longitudinal axis 22. These vibrations along longitudinal axis 22 are advantageously able to be damped by damping element 25. The propagation of vibrations from common injection rail 14 of fuel distributor 2 to add-on structure 23, in particular, is effectively damped by damping element 25.

The development of holder 3 will be described in greater detail in the following text also with reference to FIG. 3.

Figure 3:
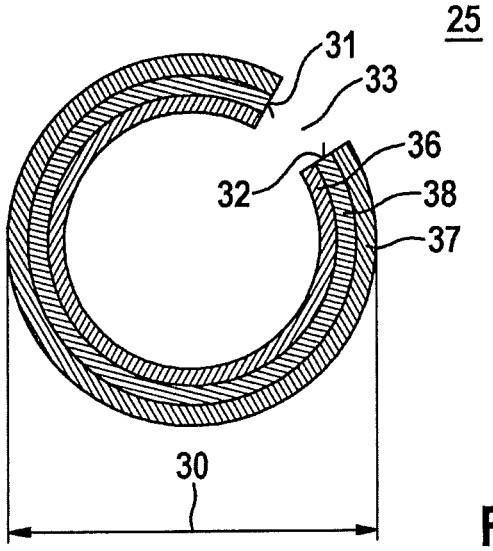
FIG. 3 shows a schematic section through a damping element of the holder shown in FIG. 2, along the cutting line denoted by III.

FIG. 3 shows a schematic section through damping element 25 of holder 3 shown in FIG. 2, along the cutting line denoted by III. In this exemplary embodiment, damping element 25 is developed in the form of a sleeve 25 which is slit along longitudinal axis 22. Damping element 25 has an outer diameter 30. Damping element 25 has side surfaces 31, 32 facing each other, between which an interspace 33 is provided. Damping element 25 is able to be compressed in such a way that side surfaces 31, 32 approach each other and possibly butt against each other. This reduces outer diameter 30 of damping element 25.

Base element 20 has a recess 35 at an inner side 34. Recess 35 of base element 20 extends circumferentially about 360° in relation to longitudinal axis 22. In this exemplary embodiment, damping element 25 has an inner layer 36, an outer layer 37 and a damping layer 38, which is situated between inner layer 36 and outer layer 37. Outer layer 37 of damping element 25 is inserted into recess 35 of base element 20. To do so, damping element 25 is compressed, so that outer diameter 30 is reduced. In the compressed state, damping element 25 is introduced into through bore 24 of base element 20. Damping element 25 is subsequently relieved of its load, so that its outer diameter 30 enlarges again. Outer layer 37 of damping element 25 is then form-fittingly connected to base element 20 on both sides.

It is subsequently possible to introduce securing sleeve 26 into through bore 24. Securing sleeve 26 is provided with a recess 40 at its outer side 39. In this exemplary embodiment, securing sleeve 26 has a recess 40 featuring a step 41 on its outer side 39. In the assembled state, inner layer 36 of damping element 25 is inserted in recess 40 of securing sleeve 26 in such a way that inner layer 36 of damping element 25 form-fittingly cooperates with step 41 of securing sleeve 26 along longitudinal axis 22. Damping element 25 is thereby form-fittingly connected to securing sleeve 26 along longitudinal axis 22 on one side. Furthermore, through outer layer 37 inserted in recess 35, damping element 25 is form-fittingly connected to base element 20 on two sides i.e., bilaterally.

In this exemplary embodiment, damping element 25 partially encloses outer side 39 of securing sleeve 26 in the assembled state, because damping element 25 has a slotted design, as shown in FIG. 3 by interspace 33.

Inner layer 36 of damping element 25 is developed as a rigid inner layer 36. Inner layer 36 may be developed as a metallic inner layer 36, in particular. Accordingly, outer layer 37 is developed as a rigid outer layer 37. Outer layer 37 may be designed as a metallic outer layer 37, in particular. Damping layer 38 is integrally connected to inner layer 36 on one side, and integrally connected to outer layer 37 on the other. Vibrations along longitudinal axis 22 therefore manifest themselves in shearing of damping layer 38. A large cross section of damping layer 38 is available as a result, so to speak, across which occurring forces are distributed. The stresses that arise in damping layer 38 are correspondingly low as a consequence.

Damping element 25 may therefore have a flexible design for its placement in recess 35 of base element 20. Because of the elastic characteristic, damping element 25 increases its outer diameter 30 again during the assembly and thereby ensures a keyed connection with base element 20 in its final position. Outer diameter 30 of damping element 25 may be equal to an inner diameter 42 of recess 35 of base element 20.

Figure 4:
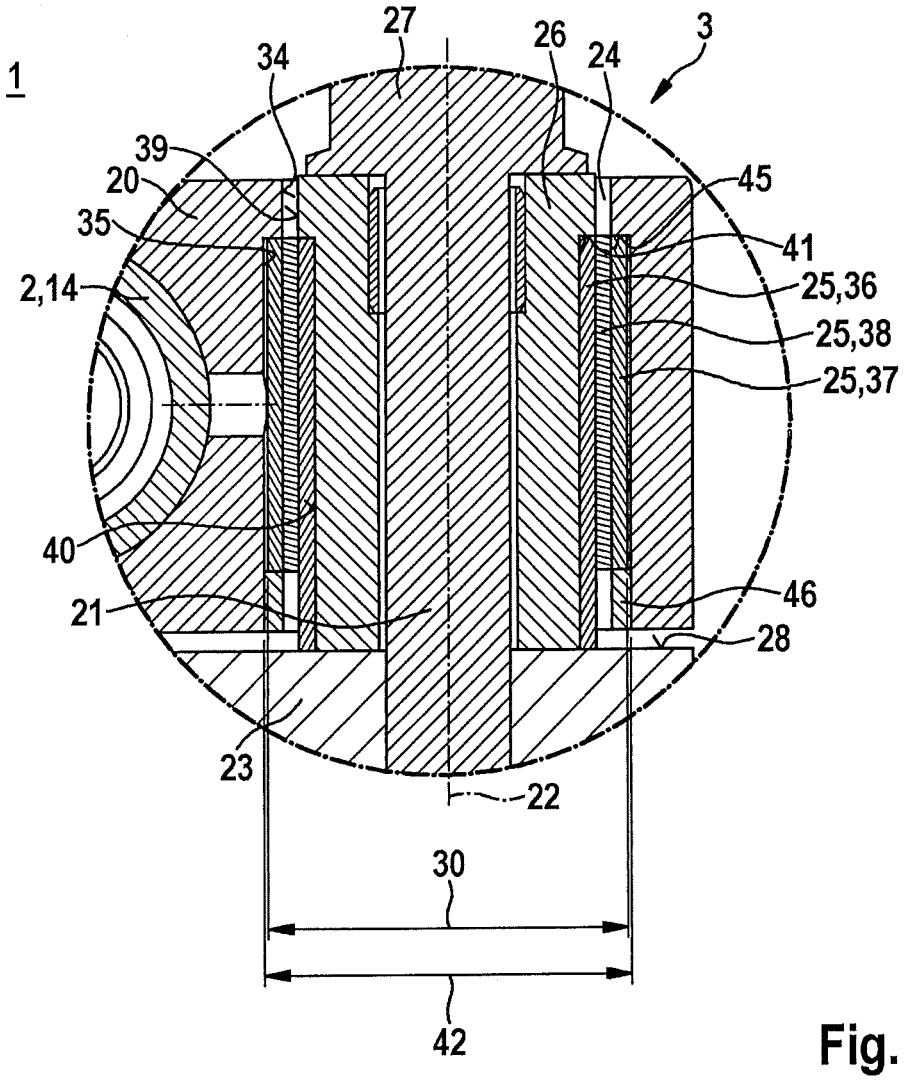
FIG. 4 shows the fuel injection system shown in FIG. 2, in an excerpted sectional view, corresponding to a second exemplary embodiment of the present invention.

FIG. 4 shows fuel injection system 1 illustrated in FIG. 2 in an excerpted sectional view, corresponding to a second exemplary embodiment. In this exemplary embodiment, recess 35 of base element 20 is initially open in the direction of top side 28 of add-on structure 23. Damping element 25 can therefore be inserted directly into base element 20 by slipping it into base element 20 along longitudinal axis 22. A certain amount of play may be provided for this purpose. In particular, outer diameter 30 of damping element 25 may be smaller than inner diameter 42 of recess 35 of base element 20. In contrast to the development of damping element 25 described with the aid of FIG. 3, damping element 25 of the second exemplary embodiment, described with the aid of FIG. 4, may be developed in the form of a sleeve-shaped damping element 25. In this case damping element 25 has no interspace 33. That is to say, damping element 25 may be closed when viewed in the circumferential direction. This makes it possible to improve the stability of damping element 25. In particular, given the same required space, damping layer 38 is able to be enlarged in its axial shearing area and thus in its volume as well.

In this exemplary embodiment, base element 20 has recess 35 including a step 45 on its inner side 34, and outer layer 37 of damping element 25 is inserted into recess 35 of base element 20. Outer layer 37 of damping element 25 thus form-fittingly cooperates with step 45 at recess 35 of base element 20 along longitudinal axis 22 on the one hand, and a clamping sleeve 46 is press-fit in recess 35 of base element 20 on the other. On the other hand, outer layer 37 of damping element 25 thus form-fittingly cooperates with clamping sleeve 46, which is press-fit in base element 20, along longitudinal axis 22. This creates a bilateral keyed connection between outer layer 37 and base element 20.

Inner layer 36 of damping element 25 cooperates with step 41 of recess 40 of securing sleeve 26 on the one hand, and with top side 28 of add-on structure 23 on the other. As a result, a bilateral fixation of inner layer 36 along longitudinal axis 22 is provided as well.

Figure 5:
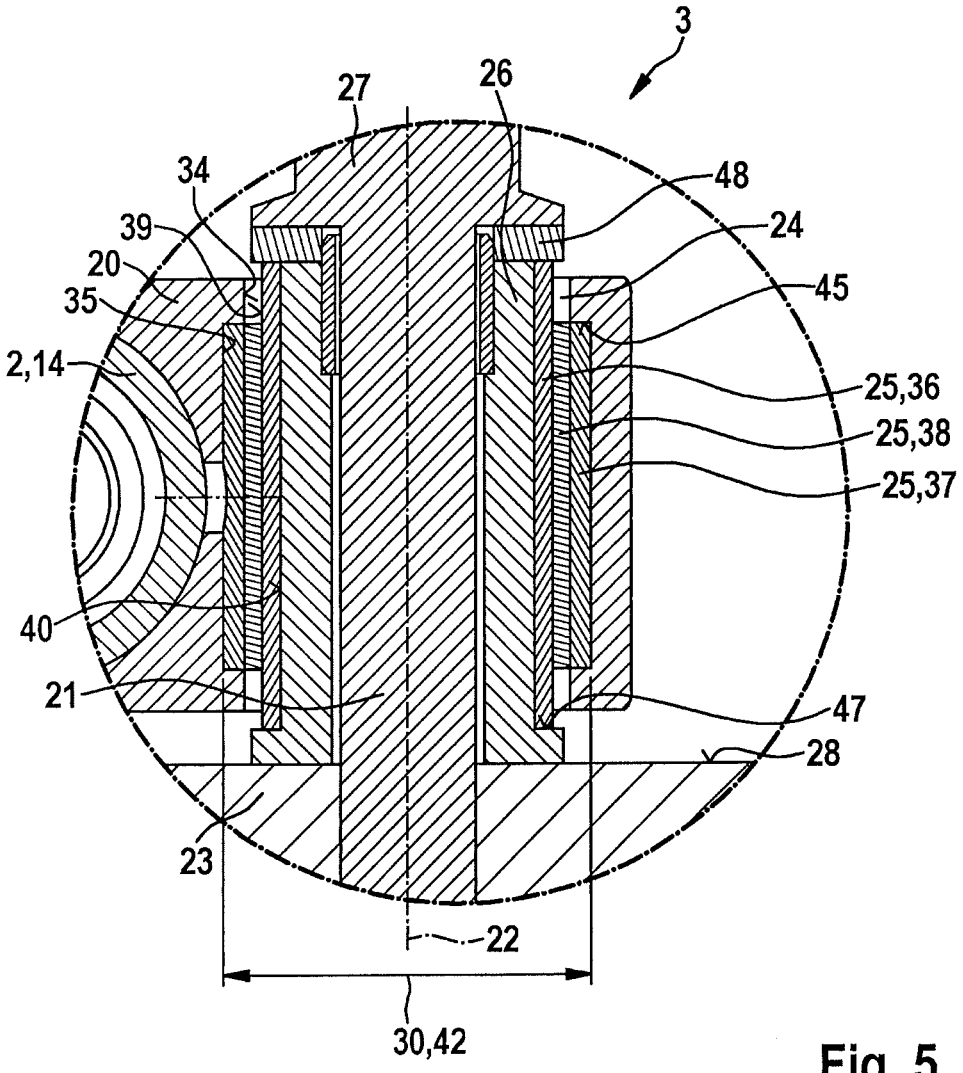
FIG. 5 shows the fuel injection system shown in FIG. 2, in an excerpted sectional view, corresponding to a third exemplary embodiment of the present invention.

FIG. 5 shows fuel injection system 1 illustrated in FIG. 2 in an excerpted sectional view, corresponding to a third exemplary embodiment. In this exemplary embodiment, recess 40 of securing sleeve 26 includes a step 47. Inner layer 36 of damping element 25 is thereby form-fittingly connected to securing sleeve 26 along longitudinal axis 22 on one side. In addition, a support ring 48 is situated between head 27 of fastening element 21 and securing sleeve 26. Support ring 48 is large enough to be disposed between inner layer 36 of damping element 25 and head 27 as well. Via support ring 48, head 27 of securing element 21 acts on securing sleeve 26 in the direction of top side 28 of add-on structure 23. In addition, inner layer 36 is braced on head 27 by means of support ring 48. This fixates inner layer 36 of damping element 25 on both sides, i.e., by step 47 of securing sleeve 26 on the one side, and by support ring 48 through head 27 of fastening element 21 on the other.

In this exemplary embodiment, damping element 25 may be developed in the form of a slotted sleeve, as described with the aid of FIG. 3. In a modified development, however, damping element 25 may also be realized in the form of a sleeve, for example in that a clamping sleeve 46 is used to seal a recess 35 of base element 20 that is open on one side, as described with the aid of FIG. 4.

It should be noted that damping element 25 also may be connected to securing sleeve 26 in an integral fashion. Inner layer 36 of damping element 25 may be omitted in such a development, and damping layer 38 is able to be connected to outer side 39 of securing sleeve 26 directly. Outer side 39 of securing sleeve 26 may also be developed in the shape of a cylinder sleeve in this development.

As a result, it is possible to retain the relatively rigid connection of fuel distributor 2, damping element 25 notwithstanding. The elasticity of the mounting of fuel distributor 2 increases only slightly, as the case may be. All functional requirements, especially a low relative movement of fuel distributor 2 and fuel injectors 10 through 13 connected to it, in relation to add-on structure 23, as well as the stability requirements, especially a load-bearing capacity of fastening elements 21, are satisfied as a result. Acoustical, functional and strength requirements resulting from the design of fuel distributor 2 are thus able to be satisfied at the same time.

The vibrational amplitudes, and thus the vibrational loading of fuel distributor 2 and the connected components, such as a pressure sensor and a plug, are reduced.

The structure-borne noise excitation of the internal combustion engine with regard to fuel distributor 2 is able to be reduced with the aid of damping element 25. Also advantageous is the low vibration loading of fuel distributor 2.

The noise components directly radiated by fuel distributor 2 are able to be reduced by the greater component damping provided by damping element 25.

Because of the lowered structure-borne noise transmission, the airborne sound radiation to add-on structure 23, which is excited by the structure-borne noise, drops as well. The structure-borne noise transmission to a chassis or the like via additional components is reduced in addition. This lowers the noise generation in all cases.

In addition, the required space for damping element 25 is very low, so that no essential additional space is needed for holders 3, 4, 5. This is due to the fact that damping element 25 in the form of a sleeve or partial sleeve can make optimal use of the clamping length of fastening element 21, which is required anyway, in order to compensate for the relaxation in the securing joint, especially the screw joint.

The decoupling may be employed in a directly connected fuel distributor 2, in which injection valves 10 through 13, prestressed via O-rings, for instance, are fixed in position in cups 6 through 9. In the direction of fuel injectors 10 through 13, fuel injectors 10 through 13 then do not rest against a stop provided by fuel distributor 2. Instead, the force resulting from the rail pressure presses fuel injectors 10 through 13 against add-on structure 23, especially cylinder head 23, and thereby fixes them in place.

The decoupling may be used on a line-bound fuel distributor 2 or on a fuel distributor 2 decoupled on the injector side, in which fuel injectors 10 through 13 are either form-fittingly connected to fuel distributor 2 via a line or as an alternative, are connected to fuel distributor 2 in a form-fitting manner such as via clips, detents or a screw joint, for instance. In this case damping elements 25 absorb only operating loads from the combustion chamber pressure and from the vibrational load of the internal combustion engine.

The avoidance of static pretensioning forces, such as screw pretensioning forces, acting on damping elements 25 makes it possible to optimally adapt the rigidity of holders 3 through 5 to the requirements for an acoustic optimization when using damping elements 25 in sleeve shape or in partial sleeve shape, a relatively soft development being possible, in particular.

By utilizing the shearing principle of damping elements 25, the operating load is distributed across large surfaces. Material overloading, especially of the elastomeric material, of damping element 25 for damping layer 38 is therefore able to be effectively avoided.

In addition, damping element 25 is characterized by simple manufacturability and thus by low manufacturing costs. In particular, a planar sheet composite is able to be cut to size and bent in order to produce sleeve-shaped or partially sleeve-shaped damping elements 25. Damping layer 38 may be produced by laminating it on top or to the inside. Another production possibility consists of connecting tube sections of different diameters by means of laminated elastomer layers, and of thereby producing closed sleeve-shaped damping elements 25.

The present invention is not restricted to the exemplary embodiments described.

What is claimed is:

1. A holder for mounting a fuel distributor on an internal combustion engine, comprising:
- a base element connected to the fuel distributor;
- a damping element disposed in a through bore of the base element;
- a fixation element which extends through the through bore in order to mount the base element on the internal combustion engine along a longitudinal axis of the through bore of the base element; and
- a securing sleeve;
- wherein:
  - the damping element:
    - at least partially encloses an outer side of the securing sleeve;
    - is at least one of (a) form-fittingly connected to the securing sleeve along the longitudinal axis and (b) integrally connected to the securing sleeve along the longitudinal axis;
    - is form-fittingly connected to the base element along the longitudinal axis; and
    - includes an elastically deformable damping layer and at least one rigid layer; and
  - at least one of:
    - the connection of the damping element to the securing sleeve is by connection of a rigid layer of the at least one rigid layer to the securing sleeve; and
    - the connection of the damping element to the base element is by connection of a rigid layer of the at least one rigid layer to the base element.

2. The holder as recited in claim 1, wherein:
- the at least one rigid layer of the damping element includes:
  - an inner rigid layer that is form-fittingly connected to the securing sleeve along the longitudinal axis; and
  - an outer rigid layer that is form-fittingly connected to the base element along the longitudinal axis; and
- the elastically deformable damping layer is disposed between the inner rigid layer and the outer rigid layer.

3. The holder as recited in claim 2, wherein the inner and outer rigid layers and the elastically deformable damping layer are integrally connected to each other.

4. The holder as recited in claim 3, wherein the inner rigid layer is a metallic inner layer, and the outer rigid outer layer is a metallic outer layer.

5. The holder as recited in claim 2, wherein the base body has a recess on an inner side, and the outer rigid layer is inserted into the recess of the base body so that the outer rigid layer is form-fittingly connected to the base body along the longitudinal axis.

6. The holder as recited in claim 5, wherein the damping element is a sleeve slotted along the longitudinal axis.

7. The holder as recited in claim 5, wherein the form fitting connection of the outer rigid layer to the base body is present on opposite sides of the longitudinal axis.

8. The holder as recited in claim 5, wherein the form fitting connection of the outer rigid layer to the base body is present circumferentially around the longitudinal axis.

9. The holder as recited in claim 2, wherein:
- the base body includes a recess having a step on an inner side; and
- the outer rigid layer:
  - is inserted into the recess of the base element;
  - form-fittingly cooperates with the step at the recess of the base element along the longitudinal axis; and
  - form-fittingly cooperates with a clamping sleeve, which is press-fit in the recess of the base element, along the longitudinal axis.

10. The holder as recited in claim 9, wherein the damping element is sleeve-shaped.

11. The holder as recited in claim 2, wherein an outer side of the securing sleeve includes a recess having at least one step, and the inner rigid layer is inserted into the recess of the securing sleeve so that the inner rigid layer form-fittingly cooperates with the step of the securing sleeve along the longitudinal axis.

12. The holder as recited in claim 5, wherein the inner rigid layer (i) form-fittingly cooperates with the step of the securing sleeve along the longitudinal axis, and (ii) is at least indirectly braced on a head of the fixation element.

13. A holder for mounting a fuel distributor on an internal combustion engine, comprising:
- a base element connected to the fuel distributor;
- a damping element disposed in a through bore of the base element;
- a fixation element which extends through the through bore in order to mount the base element on the internal combustion engine along a longitudinal axis of the through bore of the base element; and
- a securing sleeve;
- wherein:
  - the damping element:
    - at least partially encloses an outer side of the securing sleeve;
    - is at least one of (a) form-fittingly connected to the securing sleeve along the longitudinal axis and (b) integrally connected to the securing sleeve along the longitudinal axis; and
    - is form-fittingly connected to the base element along the longitudinal axis; and
  - at least one of:
    - (I) a recess is formed in an outer side of the securing sleeve, the recess forms a step, a least a portion of the damping element is arranged in the recess, and the damping element cooperates with the step formed by the recess of the outer side of the securing sleeve for limiting relative movement between the damping element and the securing sleeve in a direction parallel to the longitudinal axis; and
    - (II) a recess is formed in an inner side of the base element, the recess forms a step, a least a portion of the damping element is arranged in the recess, and the damping element cooperates with the step formed by the recess of the inner side of the base element for limiting relative movement between the damping element and the base element in the direction parallel to the longitudinal axis.

* * * * *